US008100570B2

(12) United States Patent
Borgschulte et al.

(10) Patent No.: US 8,100,570 B2
(45) Date of Patent: Jan. 24, 2012

(54) LED LENS MOUNTING DEVICE

(75) Inventors: Hubert Borgschulte, Anrochte (DE); Heinz-Uwe Spork, Lippstadt (DE); Jörg Sudahl, Lippstadt (DE)

(73) Assignee: Hella KGAA Hueck & Co., Lippstadt (DE)

( * ) Notice: Subject to any disclaimer, the term of this patent is extended or adjusted under 35 U.S.C. 154(b) by 417 days.

(21) Appl. No.: 12/476,250

(22) Filed: Jun. 1, 2009

(65) Prior Publication Data

US 2009/0303726 A1 Dec. 10, 2009

Related U.S. Application Data

(60) Provisional application No. 61/058,787, filed on Jun. 4, 2008.

(51) Int. Cl.
*F21V 19/02* (2006.01)

(52) U.S. Cl. ..... 362/523; 362/249.03; 362/294; 362/311.02; 362/545; 362/547; 362/289; 362/373

(58) Field of Classification Search ..... 362/249.03, 362/285, 289, 294, 311.02, 373, 508, 512, 362/523, 524, 530, 547
See application file for complete search history.

(56) References Cited

U.S. PATENT DOCUMENTS 5,390,089 A * 2/1995 Denley ..... 362/530
7,114,837 B2 * 10/2006 Yagi et al. ..... 362/523

FOREIGN PATENT DOCUMENTS

WO 2007128762 A1 11/2007

* cited by examiner

*Primary Examiner* — Stephen F Husar
(74) *Attorney, Agent, or Firm* — Robert C. Haldiman; Husch Blackwell LLP

(57) ABSTRACT

A headlight for a vehicle has a lens, a mounting frame, an LED on an LED board. The LED board is mounted on a heat sink. The heat sink has a first adjustment slot and a second adjustment slot. Each of the slots is dimensioned and disposed to closely cooperate with an eccenter adjustment device mounted on one of the LED module or an LED module carrier, said eccenters being adjustable on a fulcrum such that adjustment of one of the eccenters adjusts one of a first position or a second position of the LED module within a plane normal to an optical axis of a lens mounted in a fixed position relative to the LED module carrier.

8 Claims, 5 Drawing Sheets

2

LED LENS MOUNTING DEVICE

CROSS-REFERENCE TO RELATED APPLICATIONS

This application claims priority to U.S. Provisional Application 61/058,787 filed Jun. 4, 2008.

BACKGROUND OF THE INVENTION

1. Field of the Invention

The present invention is an adjustable mount for an LED used in lights such as automobile headlights.

2. Related Art

LED lens modules have a short focal length. This requires a very accurate positioning of the LEDs relative to the optical axis of the lens to fulfill the optical requirements. Because of the relatively large tolerances of the parts included in the system, adjustments of the LED are often needed. To minimize the adjustment range, the lens should be positioned relative to the lens as accurately as possible.

Current positioning of the lens in the lens frame system works with static attachment points. There is a gap between lens and frame that is incorporated into the system to allow for tolerances. This gap and variability of the frame parts that define the gap frequently cause the position of the lens to be relatively incorrect. A larger adjustment area is needed.

To define the position of the lens in the frame, a device to adjust the position of the LED relative to the optical axis of the lens in all three grid directions is needed.

A defined position of the lens in the frame causes a reduced adjustment range of the LED. There is a need to improve upon prior art such as WO2007128762, filed Nov. 15, 2007.

SUMMARY OF THE INVENTION

A defined fit of lens in lens frame is made by spring tabs on defined datum points in the lens frame.

For adjustment of the LED, the LED will be fixed to the heat sink with a tight fit locater screw in form of a shoulder. The heat sink will be placed in advance on the heat sink carrier by 3 thread forming screws that get pushed through the hole screws. The heat sink carrier is for multiple LED—Heat Sink Groups that get adjusted to each other and will add up to a complete beam pattern. The lens frame(s) with the lens(es) is attached to the other side of the heat sink carrier. By turning the hole screw the LED gets adjusted in the direction of the optical axis.

In the plane normal to the optical axis the heat sink gets adjusted by eccenter parts that go through slots in the heat sinks into holes in the heat sink carrier. After the adjustment the thread forming screws will be turned to the final torque and that way the heat sink will be fixed.

In one embodiment, a headlight for a vehicle has a lens, a mounting frame, an LED on an LED board. The LED board is mounted on a heat sink. The heat sink has a first adjustment slot and a second adjustment slot. Each of the slots is dimensioned and disposed to closely cooperate with an eccenter adjustment device mounted on one of the LED module or an LED module carrier, said eccenters being adjustable on a fulcrum such that adjustment of one of the eccenters adjusts one of a first position or a second position of the LED module within a plane normal to an optical axis of a lens mounted in a fixed position relative to the LED module carrier.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
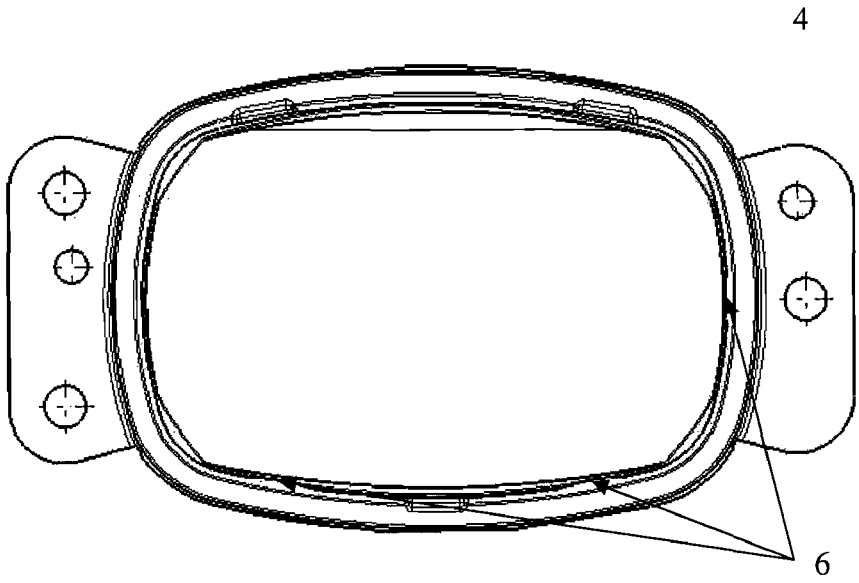
FIG. 1 is a front view of an assembled headlight.
Figure 2:
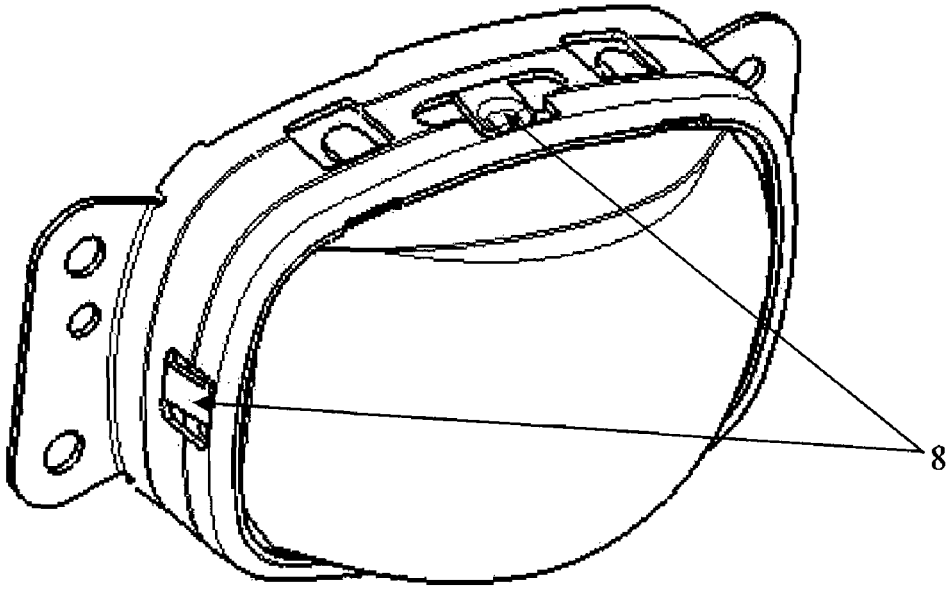
FIG. 2 is a perspective view of lens and mount.

Referring now to the drawings wherein like reference numbers indicate like elements, FIG. 1 is a front view of a headlight wherein lens 2 is mounted on frame 4 at register or datum points 6. The lens is held in place by feather or spring latches 8, seen in FIG. 2

Figure 3:
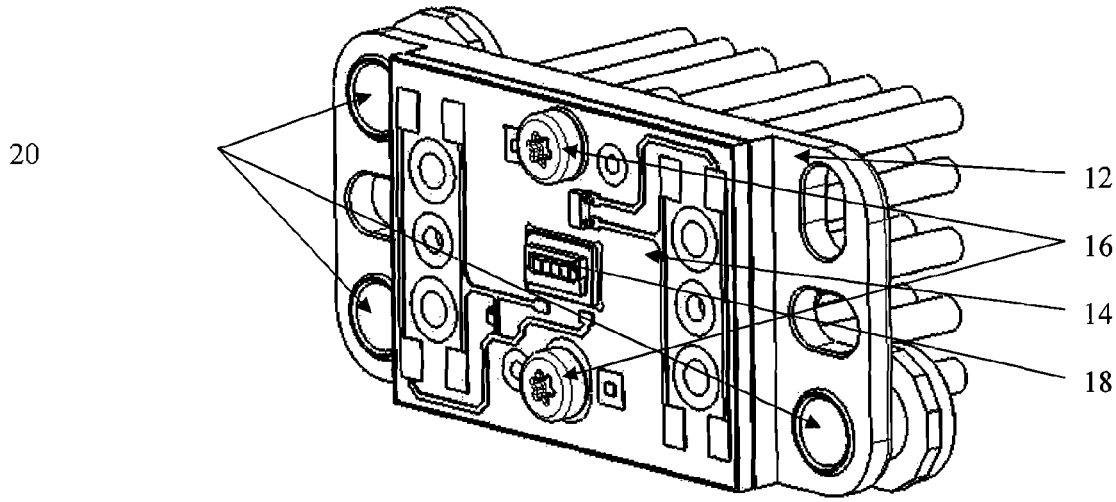
FIG. 3 is a rear perspective view of an LED module.

The LED will be mounted behind the frame. FIG. 3 depicts the LED unit 10. The LED unit 10 is comprised of a heat sink 12, the LED board 14 and LED board mounting screws 16. In the present invention, the heat sink 12 includes screw holes 20. In the center of the LED board 14 is the LED 18. Multiple LEDs or multiple LED boards may be mounted on the heat sink. Such groups may be adjusted to each other and may add up to a complete beam pattern.

The heat sink/LED module 10 is placed on a heat sink/LED carrier by three screws mounted through screw holes 20. The screws may be thread forming screws.

Figure 4:
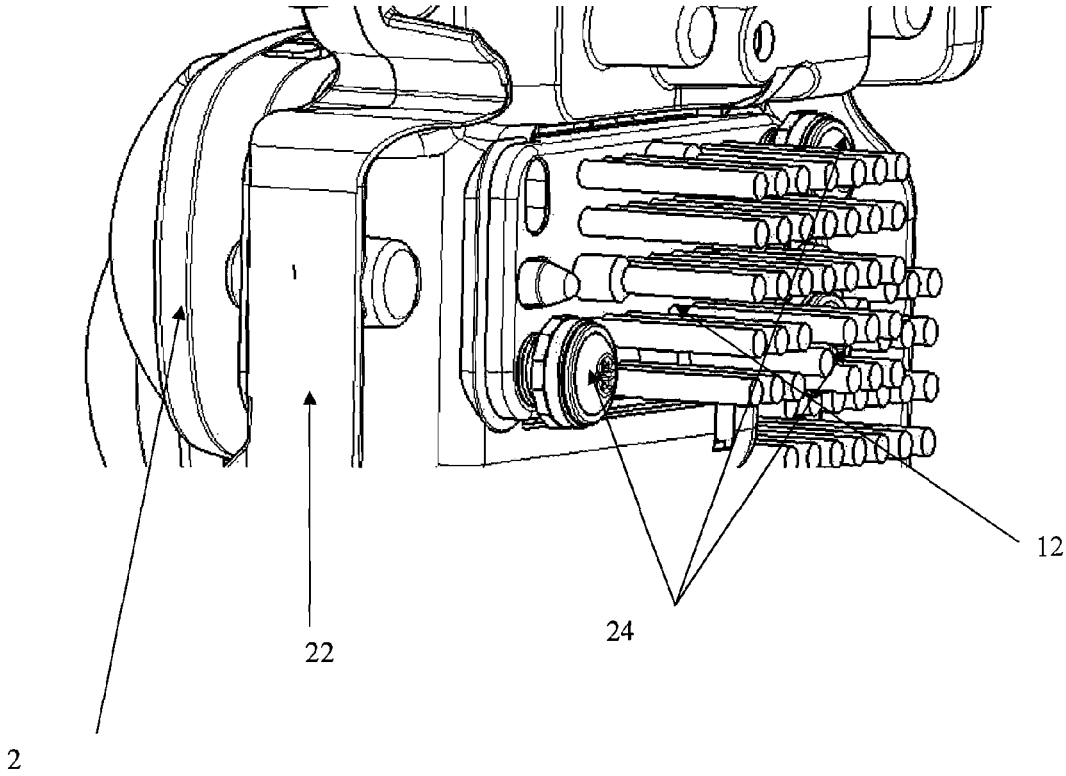
FIG. 4 is a rear perspective view of a mounted LED module.

FIG. 4 displays the heat sink carrier 22 with the LED/heat sink module mounted thereon with the screws 24 installed through hole screws 20. Opposite the heat sink module 10 from the heat sink module carrier 22 are the lens or lenses 2. The LED/heat sink module 10 is adjusted along the optical axis with the screws 24.

Figure 5:
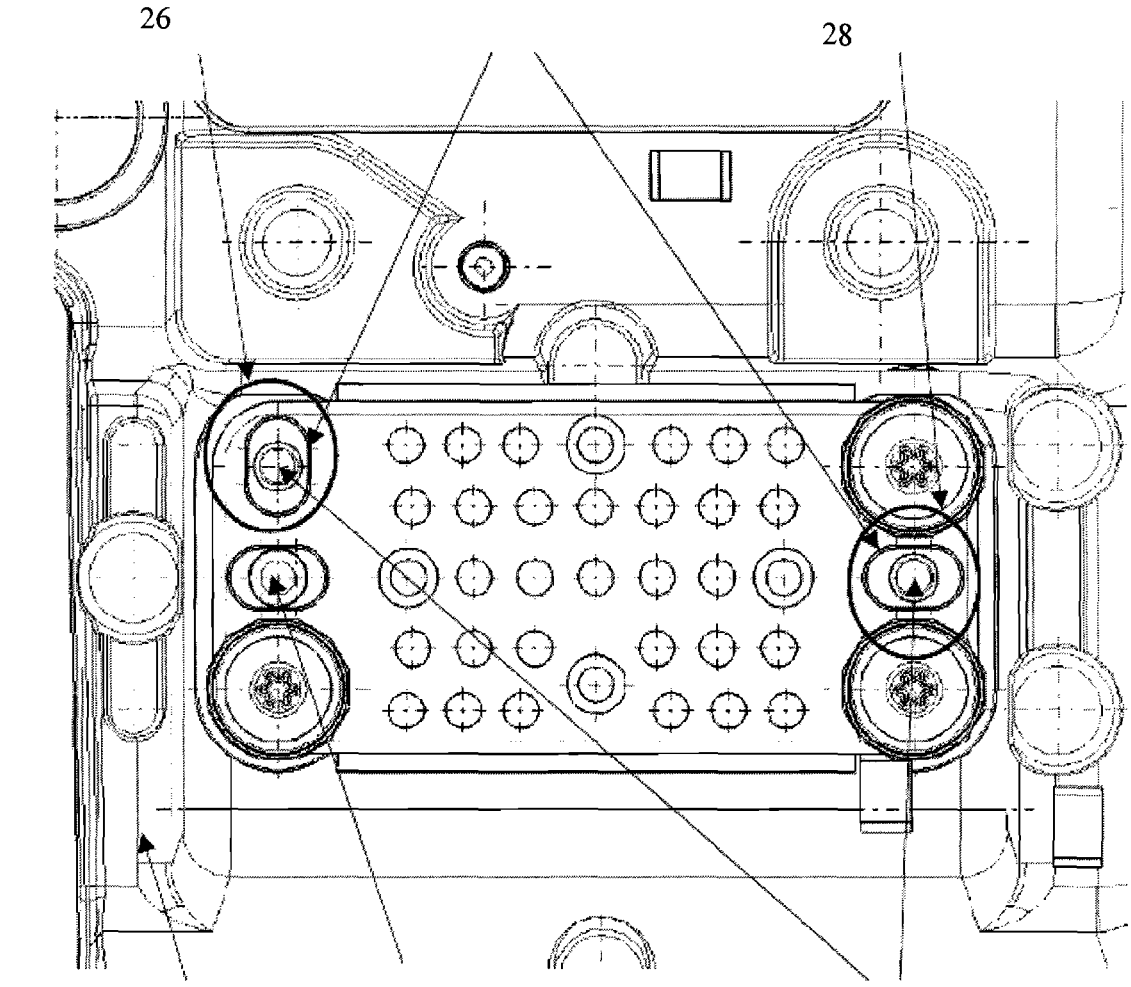
FIG. 5 is a rear view of a mounted LED module.

FIG. 5 is a plan view of the heat sink/LED module 10 as mounted on the heat sink carrier 22. FIG. 5 depicts a first adjustment slot 26, which may be horizontal or vertical and a second adjustment slot 28 which may be horizontal or vertical. In the depicted embodiment these comprise slotted holes in the heat sink 12 for eccentric cam adjustment devices. Fulcrums 30 for eccentric cam adjustment tools 30 from the heat sink mount 22 are further depicted. Finally, a positioning boss on the heat sink carrier 34 is depicted extending through a slot 36 provided for it. In the plane normal to the optical axis, the LED/heat sink is adjusted by adjustment of the eccentric cam parts that extend into the slots 26, 28 in the heat sink module 10. After horizontal and vertical adjustment is made, the screws 24 are turned to a final torque to fix the heat sink module 10 in its proper position relative to the lens 2, including the heat sink module 10 position along the optical axis.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An LED module comprising:

an LED on an LED board, said board being mounted on a heat sink;

a first adjustment slot in said heat sink a second adjustment slot in said heat sink;

each of said slots being dimensioned and disposed to closely cooperate with an eccenter adjustment device mounted on one of said LED module or an LED module carrier, said eccenters each being adjustable on a fulcrum such that adjustment of each of said eccenters adjust one of a first position or a second position of said LED module relative to a lens mounted in a fixed position relative to said LED module carrier.

2. The LED module of claim 1 wherein said adjustment positions are in a plane normal to an optical axis of said lens.

3. The LED module of claim 1 further comprising mounting screws engageable to mount said LED module to said LED module carrier.

4. The LED module of claim 3 wherein said mounting screws adjust said LED module along an optical axis of the lens.

5. A headlight for a vehicle comprising:

a lens;

a mounting frame;

an LED on an LED board, said board being mounted on a heat sink;

a first adjustment slot in said heat sink;

a second adjustment slot in said heat sink;

each of said slots being dimensioned and disposed to closely cooperate with an eccenter adjustment device mounted on one of said LED module or an LED module carrier, said eccenters each being adjustable on a fulcrum such that adjustment of each of said eccenters adjust one of a first position or a second position of said LED module relative to a lens mounted in a fixed position relative to said LED module carrier.

6. The headlight of claim 5 wherein said adjustment positions are in a plane normal to an optical axis of said lens.

7. The headlight of claim 5 further comprising mounting screws engageable to mount said LED module to said LED module carrier.

8. The headlight of claim 7 wherein said mounting screws adjust said LED module along an optical axis of the lens.

* * * * *